US011313551B2

(12) United States Patent
Zeng et al.

(10) Patent No.: US 11,313,551 B2
(45) Date of Patent: Apr. 26, 2022

(54) SHELF LAMP AND IDENTIFICATION PLATE LAMP

(71) Applicants: Self Electronics Co., Ltd., Zhejiang (CN); Wanjiong Lin, Zhejiang (CN); Self Electronics USA Corporation, Norcross, GA (US)

(72) Inventors: Guoqing Zeng, Zhejiang (CN); Zuping He, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/949,677

(22) Filed: Nov. 10, 2020

(65) Prior Publication Data

US 2021/0156557 A1 May 27, 2021

(30) Foreign Application Priority Data

Nov. 27, 2019 (CN) ..... 201911184684.4

(51) Int. Cl.

| | |
|---|---|
| ***F21V 33/00*** | (2006.01) |
| ***F21S 4/28*** | (2016.01) |
| ***F21V 5/00*** | (2018.01) |
| ***F21V 7/00*** | (2006.01) |
| ***A47F 3/00*** | (2006.01) |

(Continued)

(52) U.S. Cl.

CPC ..... *F21V 33/0012* (2013.01); *A47F 3/001* (2013.01); *F21S 4/28* (2016.01); *F21V 5/00* (2013.01); *F21V 5/007* (2013.01); *F21V 7/005* (2013.01); *F21W 2131/405* (2013.01); *F21Y 2115/10* (2016.08)

(58) Field of Classification Search

CPC .. F21V 33/0012; F21V 7/0016; F21V 17/108; F21V 33/00; A47F 11/10; A47F 3/001; A47F 3/04; A47F 1/126; A47F 5/0093; A47F 5/0043; G02B 6/0095; F21S 4/28; F21S 4/26; A47B 2220/0077; F21Y 2113/10; F21W 2131/405; F25D 27/00; G09F 13/04; G09F 13/18

See application file for complete search history.

(56) References Cited

U.S. PATENT DOCUMENTS 4,426,797 A * 1/1984 Burkemper ..... G09F 3/20 40/584

2012/0120666 A1* 5/2012 Moeller ..... F21V 7/0091 362/308

(Continued)

*Primary Examiner* — Fatima N Farokhrooz

(74) *Attorney, Agent, or Firm* — Wang Law Firm, Inc.

(57) ABSTRACT

A shelf lamp includes a lamp holder, a circuit board, a light source and a first optical element; the first optical element is arranged in the light emitting direction of the first illumination light to deflect upward at least part of the first illumination light; the connection line between the light source and the lower edge of the outer panel is the C direction, and the included angle between the C direction and the vertical downward direction is greater than 45°. The shelf lamp and the identification plate lamp can simultaneously illuminate the upper and lower side areas of the laminate, and achieve different lighting effects. When they are installed on each laminate, the goods on the laminate obtain the illumination of different angles and different effects in two directions.

14 Claims, 17 Drawing Sheets

(51) Int. Cl.
*F21Y 115/10* (2016.01)
*F21W 131/405* (2006.01)

(56) References Cited

U.S. PATENT DOCUMENTS

2014/0254136 A1* 9/2014 Oraw ..... F21V 19/004
362/92
2016/0100698 A1* 4/2016 Clark ..... A47F 3/001
362/612
2017/0307145 A1* 10/2017 Hollander ..... F21V 5/02
2018/0180261 A1* 6/2018 Xue ..... A47F 3/001
2018/0182267 A1* 6/2018 Zeng ..... F21S 4/20

* cited by examiner

SHELF LAMP AND IDENTIFICATION PLATE LAMP

RELATED APPLICATION

This application claims priority to a Chinese Patent Application No. CN 201911184684.4, filed on Nov. 27, 2019.

FIELD OF THE TECHNOLOGY

The present invention relates to the field of display lighting technology, with particular emphasis on a shelf lamp and identification plate lamp.

BACKGROUND OF THE INVENTION

In recent years, the use of light-emitting diodes (LED) as a light source has become more and more common. In addition to lighting equipment, general traffic signs, billboards, car lights, etc. have been changed to use light-emitting diodes as light sources. With the popularity of LED strip lights, more and more occasions start to use LED strip lights. For supermarkets, shopping malls, museums, exhibition halls and other places, a large number of shelves are used. These shelves include at least two uprights, supporting arms erected on the uprights, and at least one layer of laminates placed on the two supporting arms.

In actual use, general shelves will be equipped with at least three layers. The lighting between these layers generally comes from light sources in two directions, one is the light source on the top of buildings such as supermarkets, shopping malls, etc., and the other is the light source set under each layer. However, when the goods are placed on the shelf, the display side of the goods in the row closest to the user is often not highlighted, that is, the display side of the goods in the row closest to the user has the same illumination as other sides. Therefore, it is difficult to increase the user's desire to purchase; it will increase equipment and electricity costs by adding a row of light sources for accent lighting. Therefore, how to use a row of light sources to achieve uniform illumination of the lower layer board and the key illumination of the outer side of the upper layer board become the problems that need to be solved.

In the prior art, some technicians have proposed a strip light, which is installed on the outer panel of the laminate, and a single-row light source is provided with a beam splitting lens to achieve light splitting and illuminate the upper and lower laminates to solve the above problems. However, the lamp body is large in size and it's unable to ensure the goods on the upper and lower layers to be illuminated well.

BRIEF SUMMARY OF THE INVENTION

In view of this, the present invention provides a shelf lamp and identification plate lamp to solve the above technical problems.

a shelf lamp, comprising: the shelf lamp includes a lamp holder, a circuit board, a light source and a first optical element;

the lamp holder is provided with a mounting seat opposite to the outer panel of the laminate;

the circuit board is arranged on one side of the mounting seat facing the outer panel, and is located vertically below the plane where the upper edge of the outer panel is located;

the light source is arranged on the circuit board and its light exit direction faces toward the shelf back plate, and a plane formed by the main optical axis of the light source extending along the length direction of the outer panel is the interface, and at least part of the light from the light source above the interface is projected above the laminate as an first illumination light which illuminates the upper side of the laminate, and at least part of the light from the light source located below the interface is projected below the laminate as an second illumination light which illuminates the lower side of the laminate;

characterized in that:

the first optical element is arranged in the light emitting direction of the first illumination light to deflect upward at least part of the first illumination light;

the connection line between the light source and the lower edge of the outer panel is the C direction, and the included angle between the C direction and the vertical downward direction is greater than 45°.

the included angle between the C direction and the vertical downward direction is less than 90°.

the included angle between the C direction and the vertical downward direction is greater than 70°.

the ratio of the vertical distance between the light source and the plane where the outer panel is located to the width of the outer panel is less than 0.5.

in a plane perpendicular to the outer panel edge, the included angle between the main optical axis of the light source and the C direction is ±10°.

in a plane perpendicular to the outer panel edge, the included angle between the main optical axis of the light source and the vertical downward direction is less than 90°.

in a plane perpendicular to the outer panel edge, the connecting line between the light source and the outer panel edge is defined as the A direction, and the direction in which the light source 300 is vertically upward is defined as the B direction;

after the upper illumination light is dimmed by the first optical element, its maximum light intensity emission direction and its ½ light intensity direction close to the outer side of the laminate are both located between the A direction and the B direction.

the first optical element is an optical lens or a reflector cup.

when the first optical element is a optical lens, the first optical element includes a first light entrance surface, a total reflection surface, and a first light emitting surface, and the first light entrance surface is arranged in the light exit direction of the upper illumination light;

the total reflection surface is arranged on the outer side of the first light entrance surface along the light exit direction of the upper illuminating light and one end away from the interface is inclined toward the outer panel, and is used to totally reflect part of the upper illumination light located at and close to the interface;

the first light emitting surface refracts the light from the total reflection surface and then projects it onto the outer panel edge and its outer area.

one side of the first optical element toward the light source has a recess for disposing the light source.

the first light entrance surface comprises a concave top surface and a concave side wall, and the concave top surface is a light-condensing and light-receiving surface on the opposite side of the total reflection surface, which is used to condense part of the upper illumination light located at and close to the interface to the total reflection surface.

the first optical element further comprises:

an auxiliary light-emitting surface, one end of which is connected to the first light-emitting surface, refracts the refracted light from the recessed side wall and projects it to the outer rim and its outer area.

when the first optical element is a optical lens, the first optical element includes a first light-incoming surface and a first light-emitting surface, and the first light-incoming surface deflects at least part of the upper illuminating light upward for the first time;

the first light-emitting surface further deflects at least part of the upper illuminating light upward and projects it onto the outer rim and its outer area.

the first optical element 400 is a strip lens or a revolved body.

the shelf lamp further comprising a second optical element arranged in the light emitting direction of the lower illumination light, and the second optical element is used to deflect at least part of the lower illumination light downward.

the second optical element is an optical lens or a reflective cup.

when the second optical element is a optical lens, the second optical element 500 includes a second light incoming surface and a second light exiting surface, and the second light-incoming surface deflects at least part of the lower illumination light downward for the first time, and then the second light emitting surface further deflects the light passing through the second light entrance surface downward.

the optical lens adopted by the first optical element and the second optical element are integrally formed into a strip lens or a revolved body.

the optical lens adopted by the first optical element and the second optical element is strip lens manufactured by integral molding, and the upper and lower sides of the strip lens are respectively provided with an upper fixing edge and a lower fixing edge, the mounting seat is provided with two installation grooves extending along the length direction and oppositely arranged, and the two installation grooves are respectively inserted and fitted with the upper fixed side and the lower fixed side.

a mounting cavity for accommodating the circuit board is formed between the mounting seat and the bottom surface of the strip lens.

the lamp holder further comprises a sealed lampshade connected to the mounting seat, and the sealed lampshade includes an upper side plate, a lower side plate and a connecting plate; the upper side plate, the lower side plate are made in light-transmitting material that can emit separately the upper illumination light and the lower illumination light.

the mounting seat and the sealed lamp cover are integrally formed and manufactured to form a circumferentially sealed strip-shaped sealed cavity.

the light source comprises a plurality of point light sources arranged at intervals along the length direction, and an optical film is provided above the first optical element to stretch the point light sources into a line light source along the length direction of the strip lens.

the lamp holder further comprises a buckle structure fixedly connected to the laminate.

the lamp holder is in a strip shape, and the shelf lamp further includes end cover assemblies arranged at both ends of the lamp holder.

A identification plate lamp, comprising a identification plate mounting frame and a shelf lamp connected to the identification plate mounting frame.

the identification plate mounting frame comprises:

an identification plate splint;

a lamp body installation cavity, arranged on the back of the identification plate splint, and being used for the shelf lamp passing through;

a fixed connecting piece, used to connect the laminate.

the fixed connecting member adopts a snap structure, and the laminate is provided with grooves or edges that cooperate with the snap structure.

Technical effects of the present invention:

The shelf lamp and the identification plate lamp of the present invention can simultaneously illuminate the upper and lower side areas of the laminate, and achieve different lighting effects. When they are installed on each laminate, the goods on the laminate obtain the illumination of different angles and different effects in two directions and it plays a good display lighting effect.

BRIEF DESCRIPTION OF THE DRAWINGS

The following describes embodiments of the present invention with reference to the accompanying drawings, in which.

DETAILED DESCRIPTION OF THE INVENTION

Figure 1:
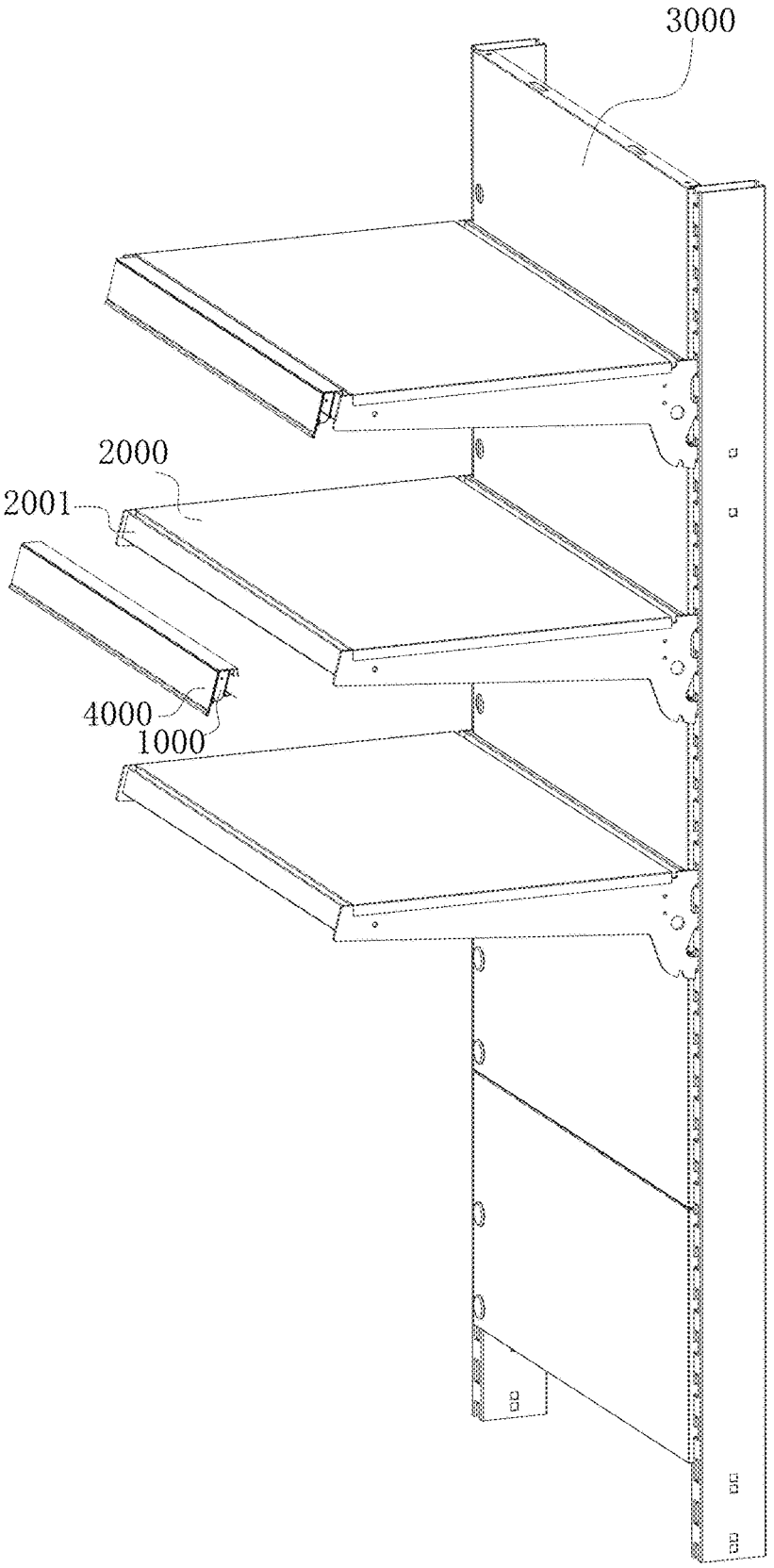
FIG. 1 is a three-dimensional schematic diagram of the identification plate lamp of embodiment 1 installed on a shelf.
Figure 2:
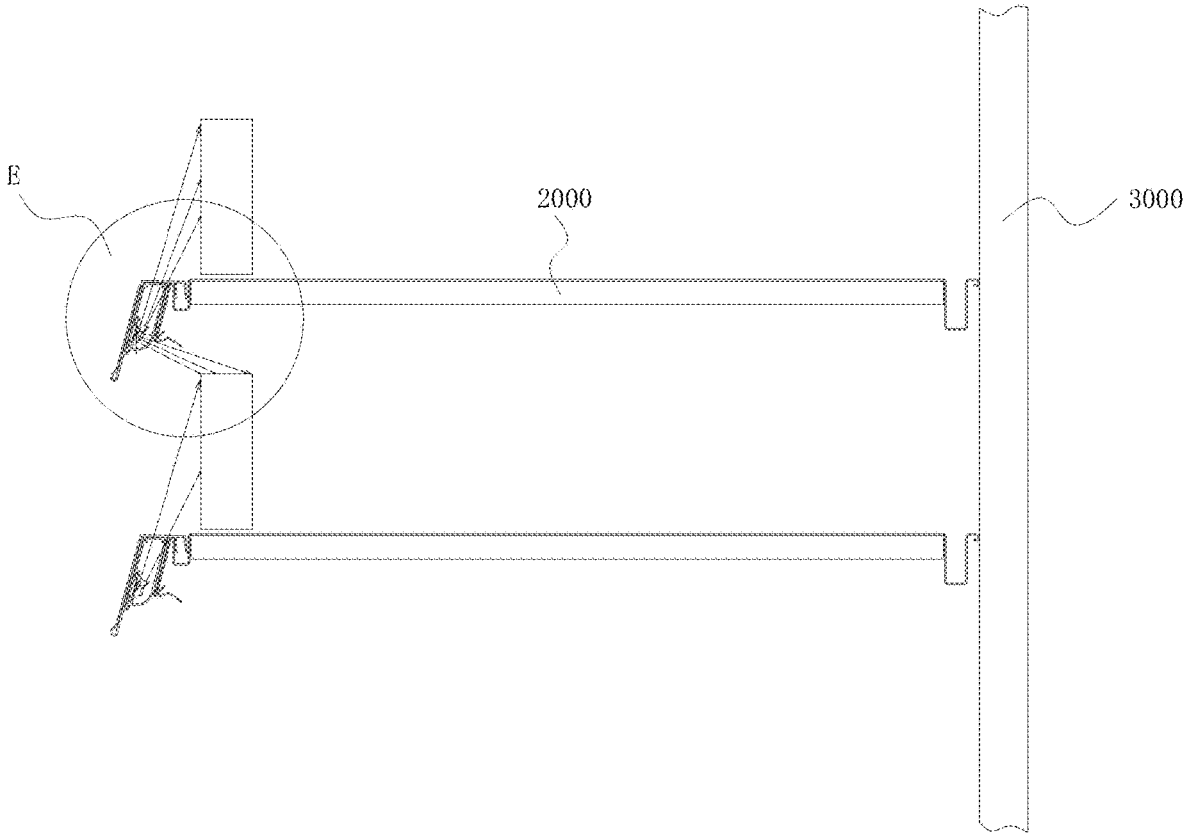
FIG. 2 is a schematic cross-sectional view of the identification plate lamp of embodiment 1 on a plane perpendicular to the longitudinal direction of the laminate after being installed on the shelf.
Figure 3:
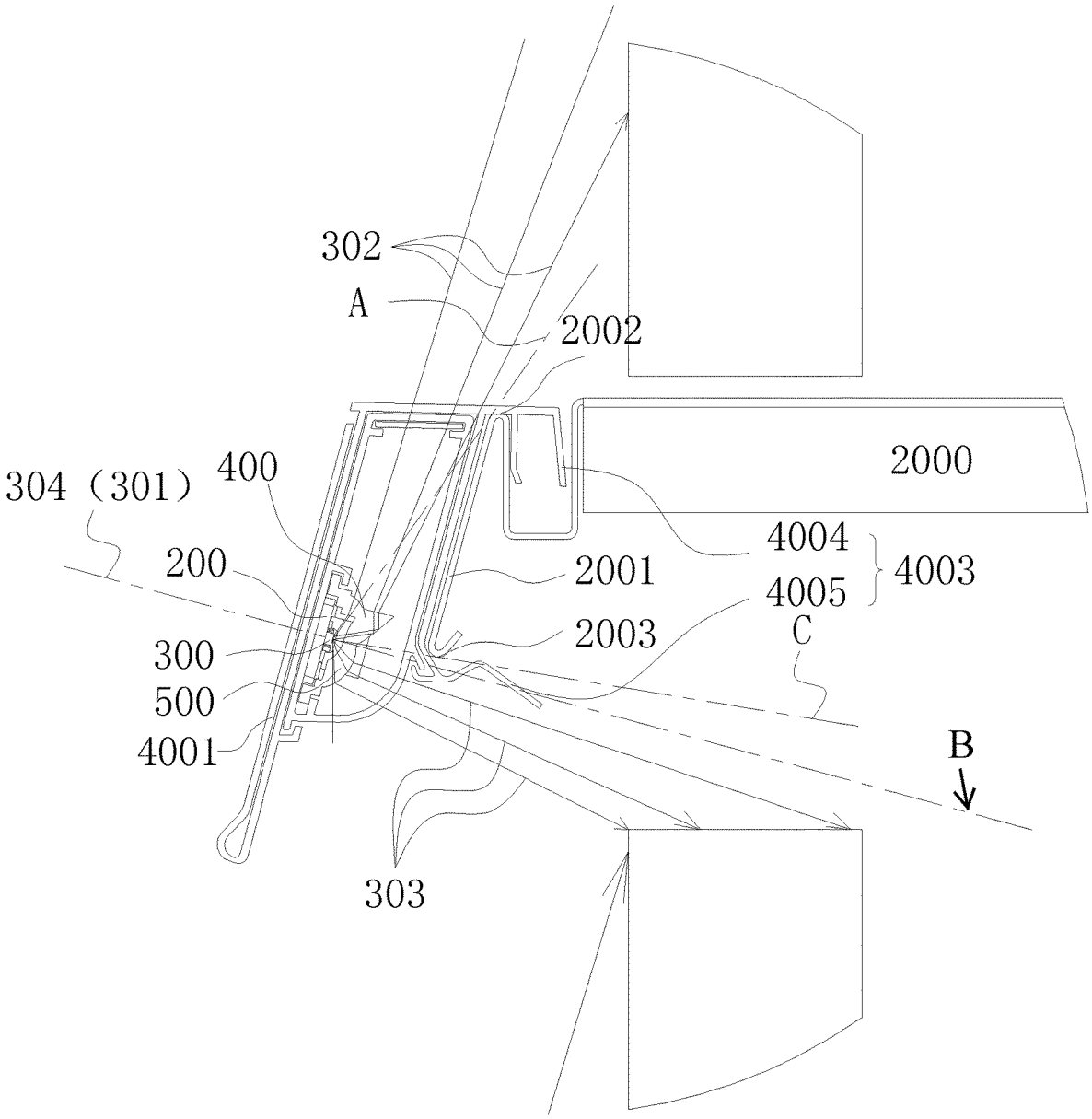
FIG. 3 is an enlarged schematic diagram of part E in FIG. 2.

Hereinafter, specific embodiments of the present invention will be described in further detail based on the drawings. It should be understood that the description of the embodiments of the present invention is not intended to limit the protection scope of the present invention.

Embodiment 1

As shown in FIGS. 1 to 9, the identification plate lamp of this embodiment includes a identification plate mounting frame 4000 and a shelf lamp 1000 connected to the identification plate mounting frame 4000.

The identification plate lamp of this embodiment is installed on the outer panel 2001 of the laminate 2000. This position is generally used to install identification plates. Therefore, combining the two can achieve the best use effect. Of course, the shelf lamp 1000 can also be used alone.

In this embodiment, the shelf lamp 1000 includes a lamp holder 100, a circuit board 200, a light source 300 and a first optical element 400.

The lamp holder 100 is used to support and fix the lamp body of the shelf lamp 1000, and is also used to install other components. After fixing, the position and angle of the light source 300 and the first optical element 400 can be limited. In this embodiment, the lamp holder 100 is provided with a mounting seat 101 opposite to the outer panel 2001 of the laminate 2000.

The circuit board 200 is arranged on one side of the mounting seat 101 facing the outer panel 2001, and is located vertically below the plane where the upper edge of the outer panel 2001 is located; the circuit board 200 is used to install the light source 300, so its position is very important for the positioning of the light source.

In this embodiment, the light source 300 is arranged on the circuit board 200 and its light exiting direction faces toward the shelf back plate 3000, and a plane formed by the main optical axis 304 of the light source 300 extending along the length direction of the outer panel 2001 is the interface 301 (the main optical axis 304 overlaps with the interface 301 in the figures). At least part of the light from the light source 300 above the interface 301 is projected above the laminate 2000 as an upper illumination light 302 which illuminates the upper side of the laminate, and at least part of the light from the light source 300 located below the interface 301 is projected below the laminate 2000 as a lower illumination light 303 which illuminates the lower side of the laminate. The normal direction of the light source 300 is set as the main optical axis 304. Generally, the main optical axis 304 is perpendicular to the plane where the circuit board 200 is located. The light emission direction is within the irradiation range with the main optical axis 304 as the center, radiating to both sides at a certain angle. The shelf lamp 1000 of this embodiment needs to illuminate the goods on the upper and lower sides of the laminate 2000. Therefore, the light emission direction of the light source 300 faces the shelf back plate 3000, the light source 300 emits light on both the upper and lower sides of the interface 301. In order to achieve key illumination to the outermost part of the goods on the laminate 2000, a first optical element 400 needs to be provided. The first optical element 400 is arranged in the light emitting direction of the upper illumination light 302 to deflect upward at least part of the upper illumination light 302.

At the same time, in order to illuminate the goods on the laminate under the laminate 2000 with a certain depth (the depth is the distance inside the laminate), the connection line between the light source 300 and lower edge 2003 of the outer panel is C direction, and the included angle between the C direction and the vertical downward direction is greater than 45°. As the position of the light source 300 moves downward, the included angle becomes larger. In order to increase the thickness of the laminate in the vertical direction through the installation of the lamp, it is further preferred that the included angle between the C direction and the vertical downward direction is less than 90°. In order to further increase the illumination depth under the laminate 2000, it is further preferred that the included angle between the C direction and the vertical downward direction is greater than 70°. In this embodiment, the included angle between the C direction and the vertical downward direction is 81°.

In order for the upper illumination light 302 to provide effective focal lighting on the outermost part of the goods on laminate 2000, in this embodiment, the upper illumination light 302 is dimmed by the first optical element 400. The maximum light intensity direction and the ½ light intensity direction close to the outer side of the laminate are located between the A direction and the B direction. In the plane perpendicular to the upper edge 2002 of the outer panel 2001, the connecting line between the light source 300 and the upper edge 2002 are defined as the A direction, and the direction in which the light source 300 is vertically upward (that is, the direction which is perpendicular to the position of the light source 300 and vertically upward) is defined as the B direction.

In order to prevent the lamp body from being too large in size in this embodiment, preferably, the ratio of the vertical distance between the light source 300 and the plane where the outer panel 2001 is located to the width of the outer panel 2001 is less than 0.5. The vertical distance between the light source 300 and the plane where the outer panel 2001 is located is 9 mm to 15 mm. In this embodiment, the vertical distance between the light source 300 and the plane where the outer panel 2001 is located is 11 mm.

In order to ensure that sufficient light can be distributed to the upper and lower sides, preferably, in a plane perpendicular to the upper edge 2002, the included angle between the main optical axis 304 of the light source 300 and the C direction is ±10° (relative to the main optical axis 304, clockwise is positive and counterclockwise is negative). In this embodiment, the included angle between the main optical axis 304 of the light source 300 and the C direction is −6°.

In order to improve the anti-glare effect, the included angle between the main optical axis 304 of the light source 300 and the vertical downward direction is less than 90°. As a result, the maximum light intensity direction of the light source 300 itself faces away from the person and is inclined downward, and the anti-glare effect can be improved in combination with the installation of the mounting seat.

Figure 4:
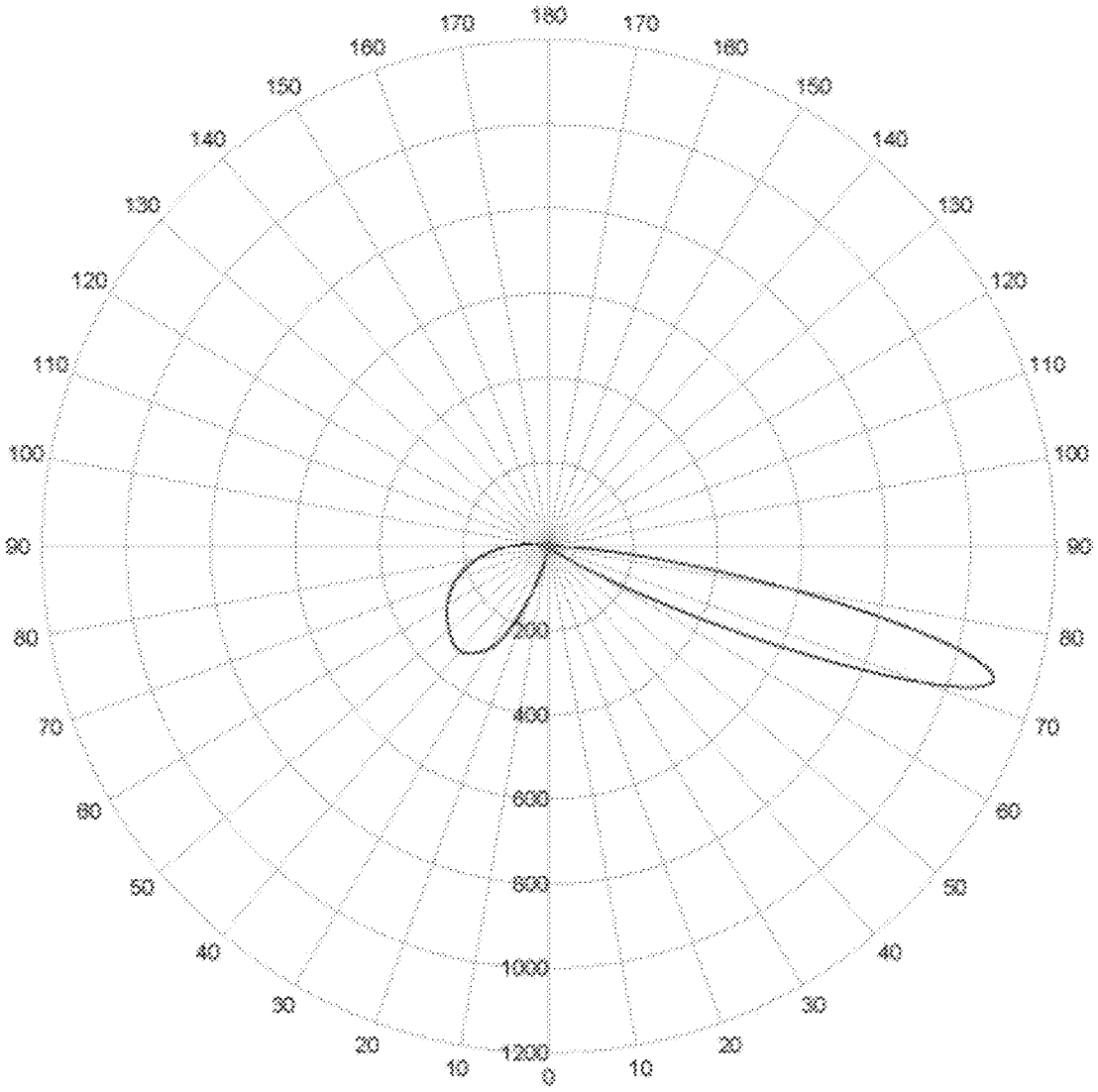
FIG. 4 is a light intensity distribution diagram of the identification plate lamp shown in FIG. 3.
Figure 5:
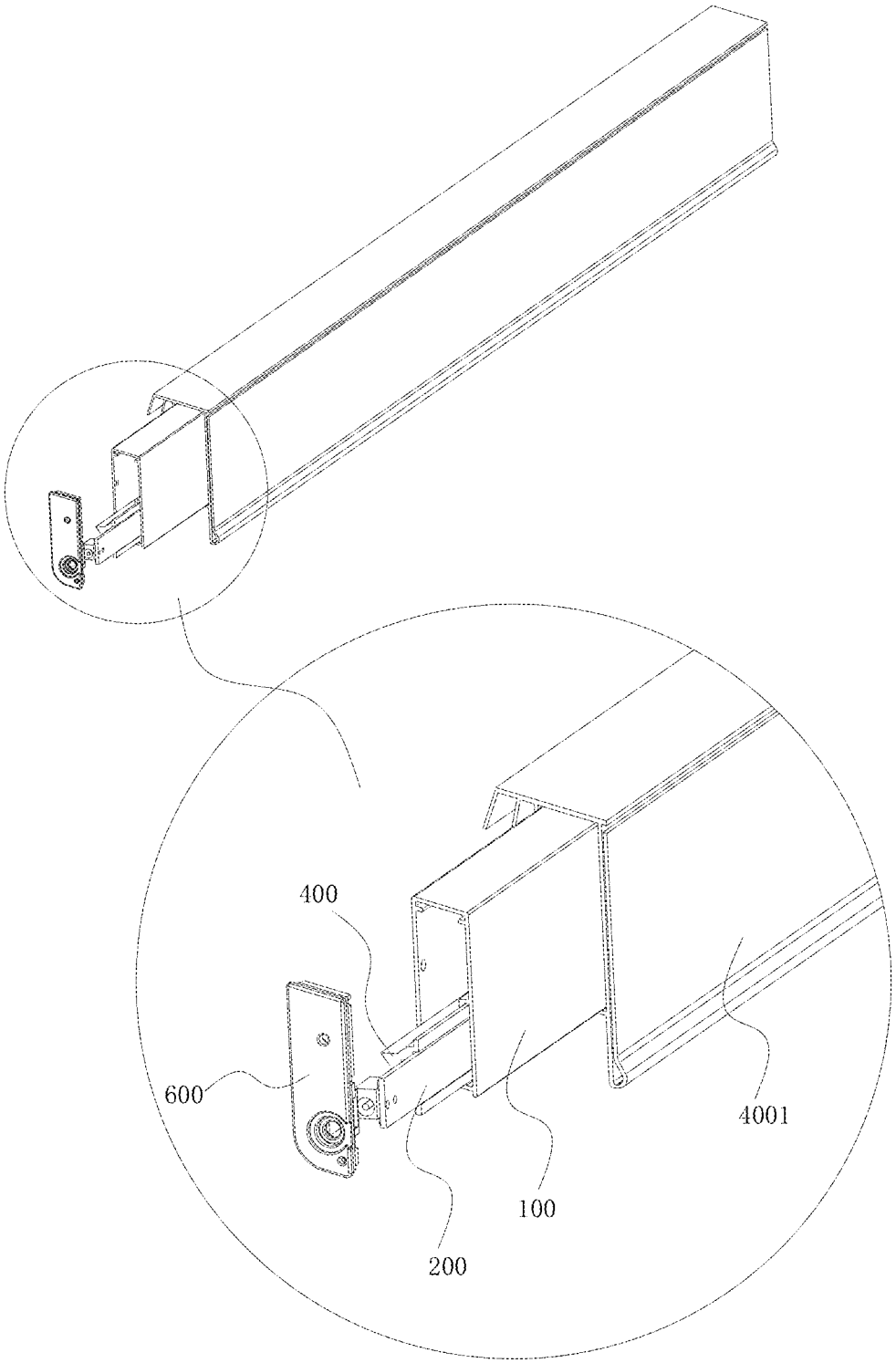
FIG. 5 is an exploded schematic diagram of one end of the identification plate lamp of embodiment 1.
Figure 6:
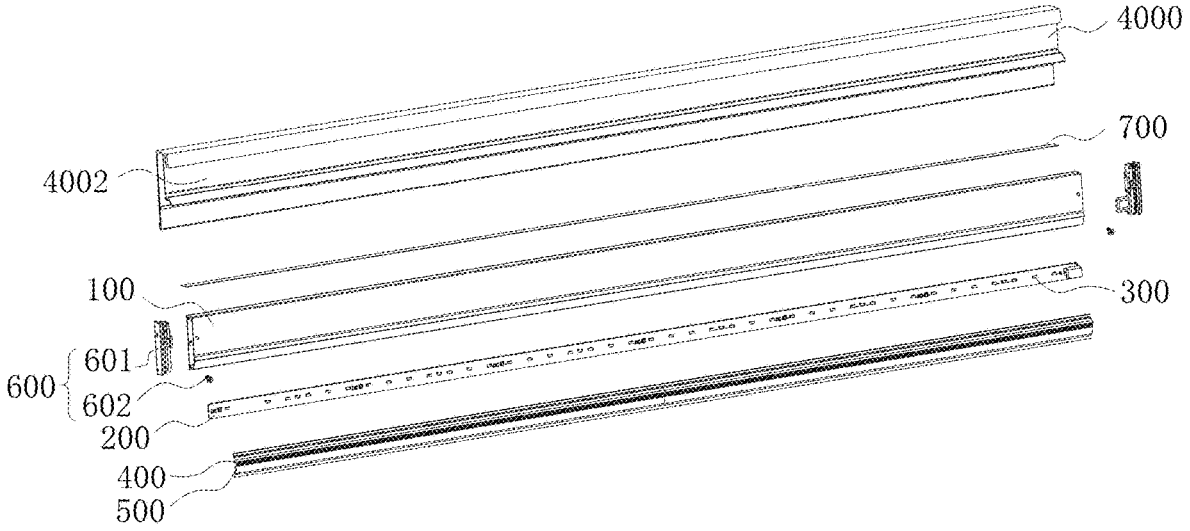
FIG. 6 is an exploded schematic diagram of the identification plate lamp of embodiment 1.
Figure 7:
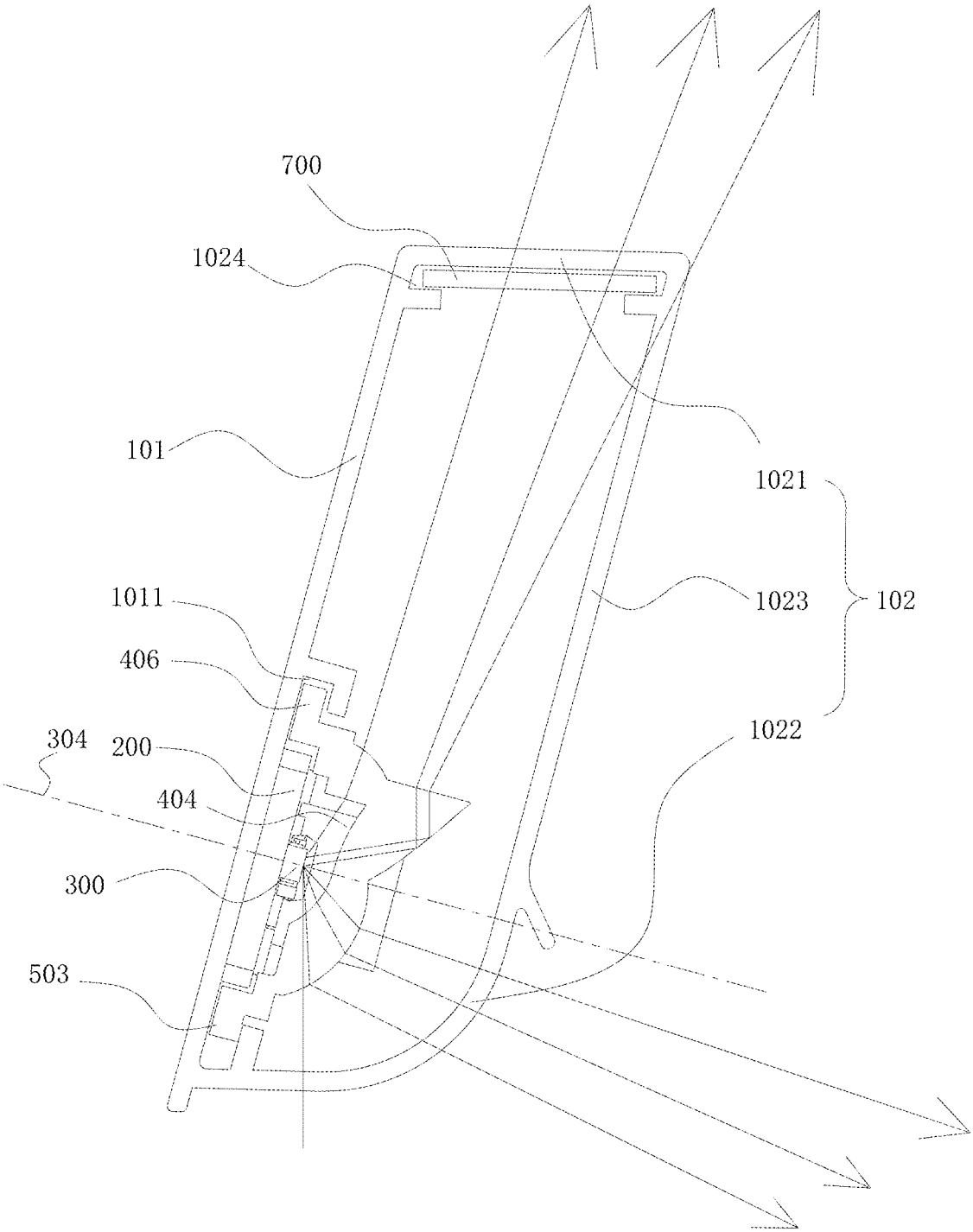
FIG. 7 is a schematic cross-sectional view of the shelf lamp of embodiment 1 on a plane perpendicular to the longitudinal direction of the laminate.
Figure 8:
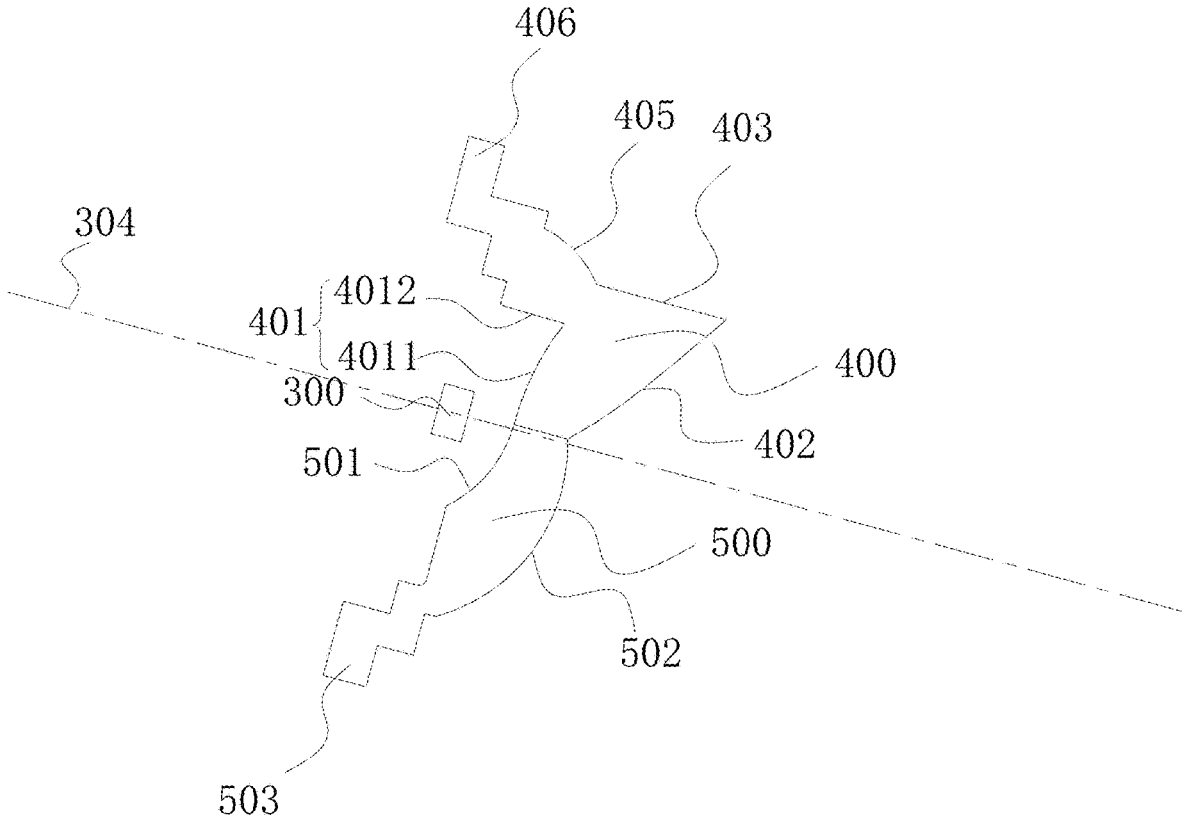
FIG. 8 is a schematic cross-sectional view of the optical element of the shelf lamp of embodiment 1 on a plane perpendicular to the longitudinal direction of the laminate.

When the light source 300 is dimmed by the first optical element 400 under the above-mentioned limited conditions, its maximum light intensity direction and the ½ light intensity direction close to the outside of the laminate are located between the A direction and the B direction, so as to achieve accent lighting on the outermost side of the goods on the upper side of the shelf. According to the distance between the layers, the maximum light intensity direction is set at different angles. Generally, the included angle between the maximum light intensity direction and the vertical upward direction of the light source is 15°~20°. The included angle between the ½ light intensity direction close to the outer side of the laminate and the maximum light intensity direction is 5°~10°, that is, the light output angle is 10°~20°, the light intensity distribution effect in this embodiment is shown in FIG. 4, the radius length is proportional to the light intensity.

For the first optical element 400 to achieve the above-mentioned effects, a preferred solution is that the first optical element 400 is a optical lens or a reflector cup.

The optical lens can achieve refraction and total reflection, thereby adjusting the light emitting angle. The reflector cup can reflect the light, thereby adjusting the light emitting angle.

When the first optical element 400 is the optical lens, it can be adjusted to the maximum light intensity direction and the ½ light intensity direction close to the outer side of the laminate is located between the A direction and the B direction by adopting total reflection or multiple refraction. In this embodiment, the first optical element 400 includes a first light entrance surface 401, a total reflection surface 402, and a first light emitting surface 403.

The first light entrance surface 401 is arranged in the light exit direction of the upper illumination light 302; the total reflection surface 402 is arranged on the outside of the first light entrance surface 401 along the light exit direction of the upper illumination light 302 and one end away from the interface 301 is inclined toward the outer side plate 2001, and is used to totally reflect part of the upper illumination light 302 located at and close to the interface 301; the first light emitting surface 403 refracts the light from the total reflection surface 402 and then projects it onto the upper edge 2002 and its outer area.

The above structure can achieve the effect to be achieved by this embodiment. In order to further reduce the size of the lamp body and improve the light efficiency, in this embodiment, one side of the first optical element 400 toward the light source 300 has a recess 404 for disposing the light source 300. Further preferably, the first light entrance surface 401 includes a recessed top surface 4011 and a recessed side wall 4012. The recessed top surface 4011 is a light-condensing and light-receiving surface located on the opposite side of the total reflection surface 402, which is used to condense part of the upper illumination light 302 located at and close to the interface 301 to the total reflection surface 402, so as to prevent the total reflection surface 402 from being too long and causing the first optical lens to be too large.

In order to improve luminous efficiency, the first optical element 400 further includes an auxiliary light emitting surface 405. One end of the auxiliary light emitting surface 405 is connected to the first light emitting surface 403, refracts the refracted light from the recessed side wall 4012 and projects it to the upper edge 2002 and its outer area.

Figure 9:
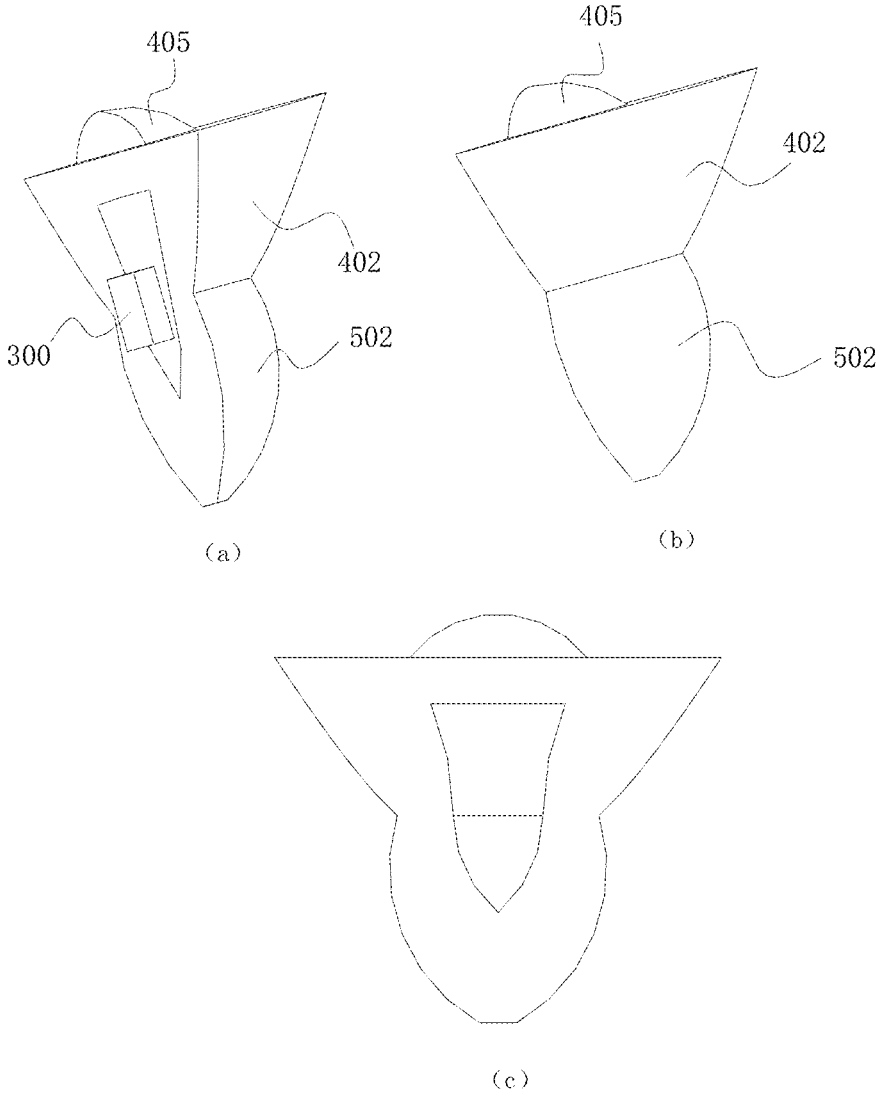
FIGS. 9(*a*) to 9(*c*) are structure diagrams in three angles of the optical element of the shelf lamp of embodiment 1 adopting the form of a rotating body.

The first optical element 400 is a strip lens or a revolved body. In this embodiment, the first optical element 400 is a strip lens extending along the length direction of the upper edge 2002. Another implementation form is that, in a plane perpendicular to the upper edge 2002, the direction passing through the light source 300 and perpendicular to the main optical axis 304 is the D direction, and the first optical element 400 is a revolved body taking the D direction as the gyration center, as shown in FIGS. 9 (*a*)~9(*c*); the above two forms can achieve the effect to be achieved by the present invention. Wherein, the strip lens is more convenient to manufacture and can be manufactured by extrusion molding, which is particularly suitable the situation that the number of light sources 300 is large and the arrangement is relatively close.

In order to make the light intensity distribution of the lower illumination light 303 more uniform, the shelf lamp of this embodiment further includes a second optical element 500 arranged in the light emission direction of the lower illumination light 303, and the second optical element 500 is used to deflect at least part of the lower illumination light 303 downward.

The second optical element 500 can be a optical lens or a reflective cup. In this embodiment, when the second optical element 500 is a optical lens, the second optical element 500 includes a second light incoming surface 501 and a second light exiting surface 502. The second light incoming surface 501 deflects at least part of the lower illumination light 303 downward for the first time; ant then the second light emitting surface 502 further deflects the light passing through the second light entrance surface 501 downward. In this embodiment, the second light entrance surface 501 and the second light exit surface 502 are both light splitting curved surfaces.

In order to simplify the structure, the optical lens adopted by the first optical element 400 and the second optical element 500 are integrally formed into a strip lens or a revolved body. In this embodiment, a strip lens is used.

The light source 300 includes a plurality of point light sources arranged at intervals along the length direction. An optical film 700 is provided above the first optical element 400 to stretch the point light sources into a line light source along the length direction of the strip lens. It does not affect the light distribution on the plane perpendicular to the length direction of the strip lens, and can achieve the effect of line light source. From the perspective of energy saving and environmental protection, the point light source uses LED chips.

In order to facilitate assembly, in this embodiment, the optical lens adopted by the first optical element 400 and the second optical element 500 is strip lens manufactured by integral molding, and the upper and lower sides of the strip lens are respectively provided with an upper fixing edge 406 and a lower fixing edge 503. The mounting seat 101 is provided with two mounting grooves 1011 extending along the length direction and arranged oppositely, and the two mounting grooves 1011 are respectively inserted and fitted with the upper fixing edge 406 and the lower fixing edge 503.

In order to facilitate the installation of the circuit board 200, in this embodiment, a mounting cavity for accommodating the circuit board 200 is formed between the mounting seat 101 and the bottom surface of the strip lens.

In most cases, the lamp body needs to be dust-proof and waterproof. In this case, the optical element can be directly installed in the lamp holder 100 as a package. However, for the convenience of manufacturing and installation, a lamp shade is generally used for packaging. In the embodiment, the lamp holder 100 also includes a sealed lampshade 102 connected to the mounting seat 101. The sealed lampshade 102 includes an upper side plate 1021, a lower side plate 1022, and a connecting plate 1023. The upper side plate 1021, the lower side plate 1022 are made in light-transmitting material that can emit separately the upper illumination light 302 and the lower illumination light 303, further, a transparent material is used. In this embodiment, the upper side plate 1021 is a flat plate arranged parallel to the surface of the laminate, and the lower side plate 1022 is an arc-shaped plate protruding outward. The connecting plate 1023 can be made of an opaque material or a diffuse material.

In order to facilitate manufacturing and installation, in this embodiment, a film installation slot 1024 is provided under the upper side plate 1021 for inserting the optical film 700.

The connecting plate 1023 is set to have the same inclination as the outer panel 2001, so that it can be attached to the outer panel 2001 during installation. At the same time, the upper plate 1021 is flush with the upper surface of the laminate 2000 to improve the matching degree of installation. The lower plate 1022 is an arc-shaped plate protruding outward, the mounting base 101 is a mounting plate parallel to the connecting plate 1023, so that the overall size is smaller, and the connecting plate 1023 is parallel to the mounting plate, so that the lamp body is smaller in size. After the upper illumination light 302 is dimmed by the first optical element 400, the maximum light intensity direction is set in parallel with the connecting plate 1023, thus a better light emission effect can be obtained.

In order to facilitate the manufacture and installation, in this embodiment, the mounting base 101 and the sealed lampshade 102 are integrally formed and manufactured to form a circumferentially sealed strip-shaped sealed cavity. The lamp holder 100 of this embodiment can be manufactured by a two-color extrusion process.

The shelf generally has a certain width. In order to better match the laminate and increase the lighting range, in this embodiment, the lamp holder 100 is strip-shaped, and the strip-shaped lights can be interconnected. When interconnection is not required, end caps are required on both sides for packaging, in this embodiment, the shelf lamp further includes end cover assemblies 600 arranged at both ends of the lamp holder 100. The end cover assembly 600 includes an end cover body 601 and a locking screw 602.

In this embodiment, the shelf lamp 1000 is used in conjunction with the identification plate mounting frame 4000, which can illuminate the goods and at the same time play the role of installing the identification plate. It can be seen that the identification plate mounting frame 4000 can be used as the lamp holder of the shelf lamp 1000 while the two cannot be separated, the applicability is poor. Therefore, in this embodiment, the identification plate mounting frame 4000 includes an identification plate splint 4001, a lamp body mounting cavity 4002 and a fixed connecting piece 4003. The lamp body installation cavity 4002 is arranged on the back of the identification plate splint 4001, and is used for the shelf lamp 1000 passing through; the fixed connecting piece 4003 is used to connect the laminate 2000. The fixed connecting piece 4003 is a structure which snaps into place, and the laminate 2000 is provided with grooves or edges that cooperate with the snapping structure.

specifically, in this embodiment, the buckle structure includes an upper buckle 4004 and a lower buckle 4005, which are respectively matched and fixed with the upper and lower sides of the outer panel 2001.

Embodiment 2

Figure 10:
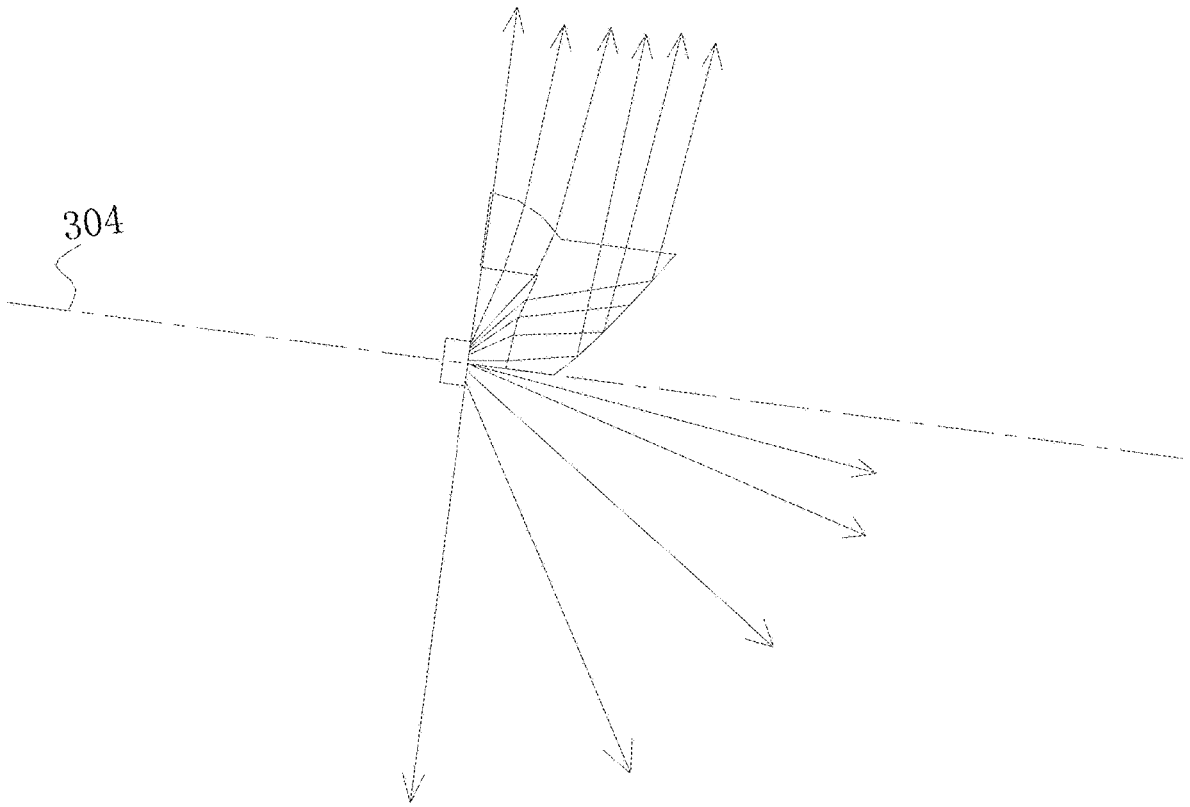
FIG. 10 is an optical path diagram of the first optical element of the shelf lamp of embodiment 2.
Figure 11:
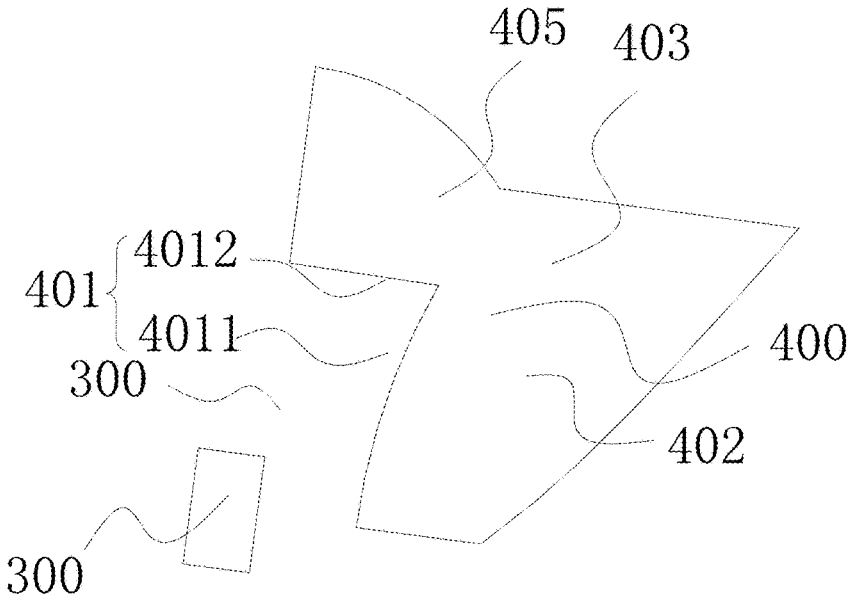
FIG. 11 is a schematic diagram of the structure of the first optical element of the shelf lamp of embodiment 2.

As shown in FIGS. 10 and 11, in this embodiment, except that the second optical element 500 is not provided, the rest of the structure is the same as that of embodiment 1.

When the second optical element is not provided, the lower illumination light 303 under the laminate is naturally emitted by the light source 300, showing the effect that the brightness of the inner side of the laminate is large and the outside is small.

Embodiment 3

Figure 12:
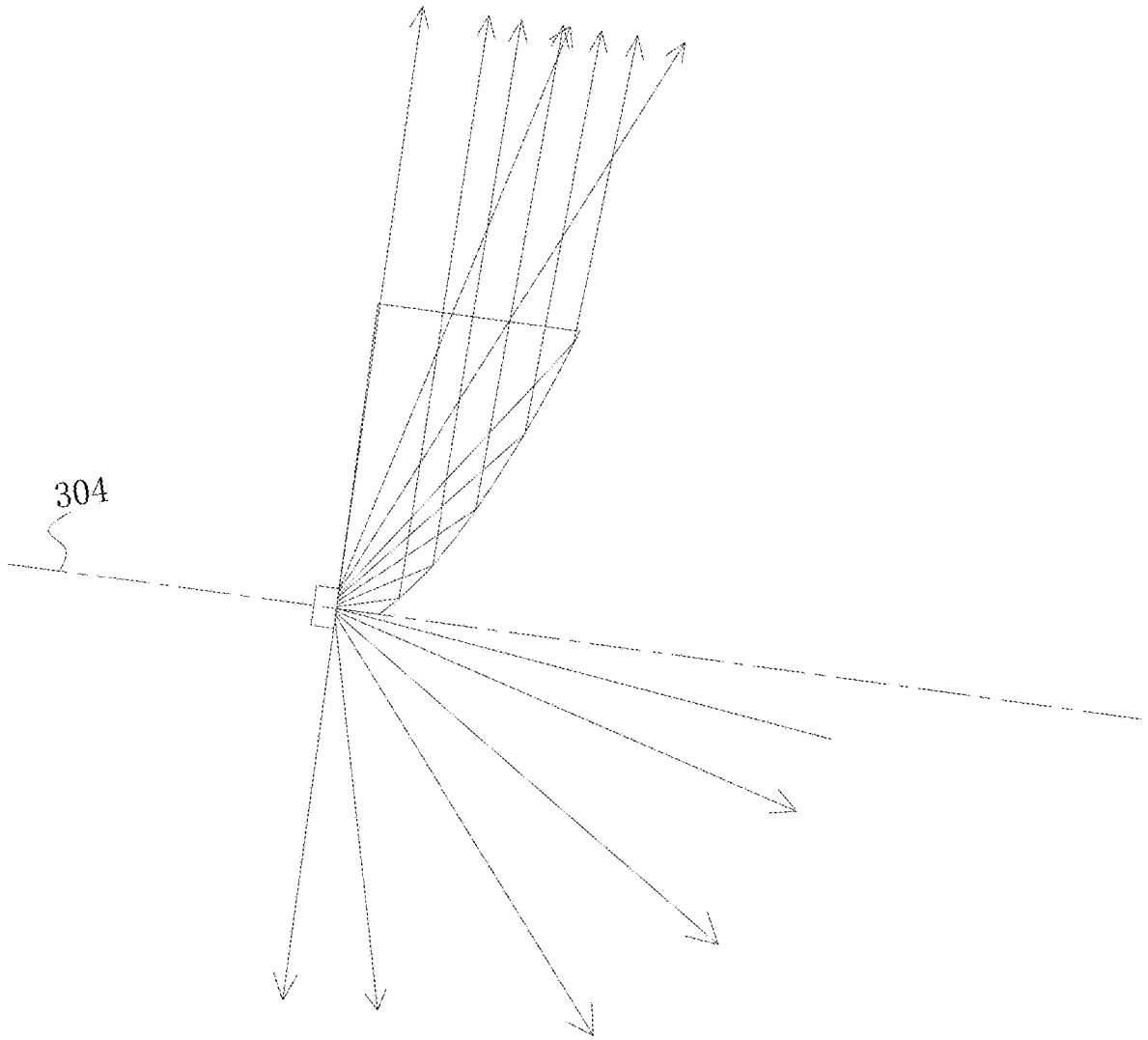
FIG. 12 is an optical path diagram of the first optical element of the shelf lamp of embodiment 3.
Figure 13:
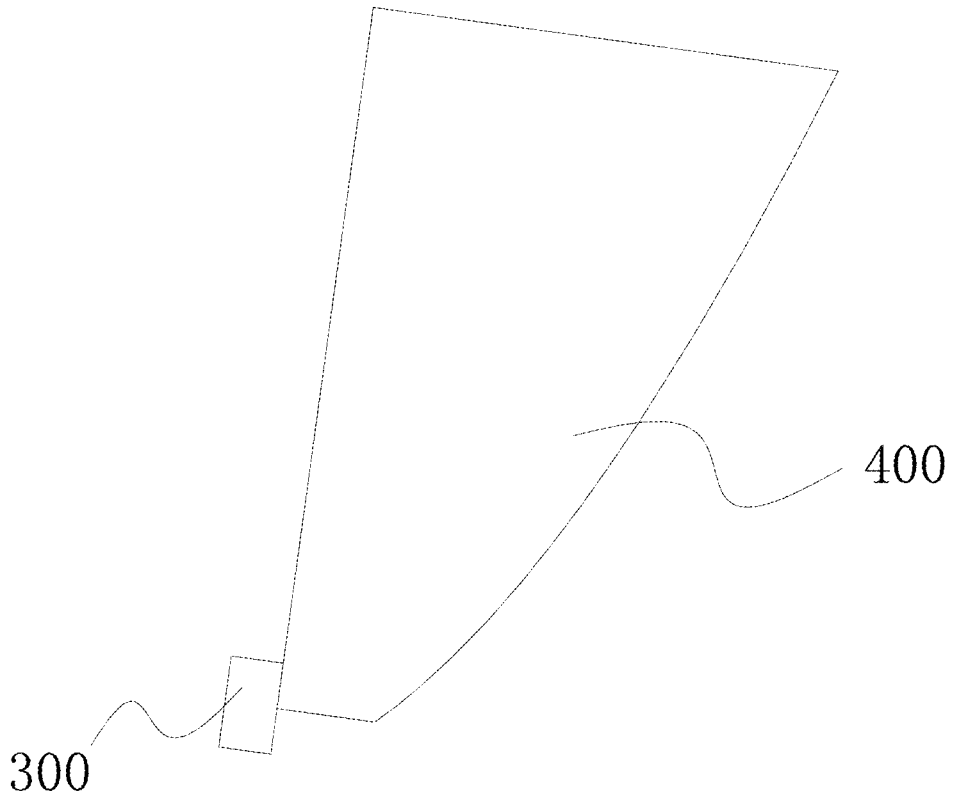
FIG. 13 is a schematic diagram of the structure of the first optical element of the shelf lamp of embodiment 3.

As shown in FIGS. 12 and 13, in this embodiment, except that the structure of the first optical element 400 is different from that of embodiment 2, the rest of the structure is the same as that of embodiment 2.

In this embodiment, the first optical element 400 is in the form of a reflective cup, which avoids the arrangement of lenses.

Embodiment 4

Figure 14:
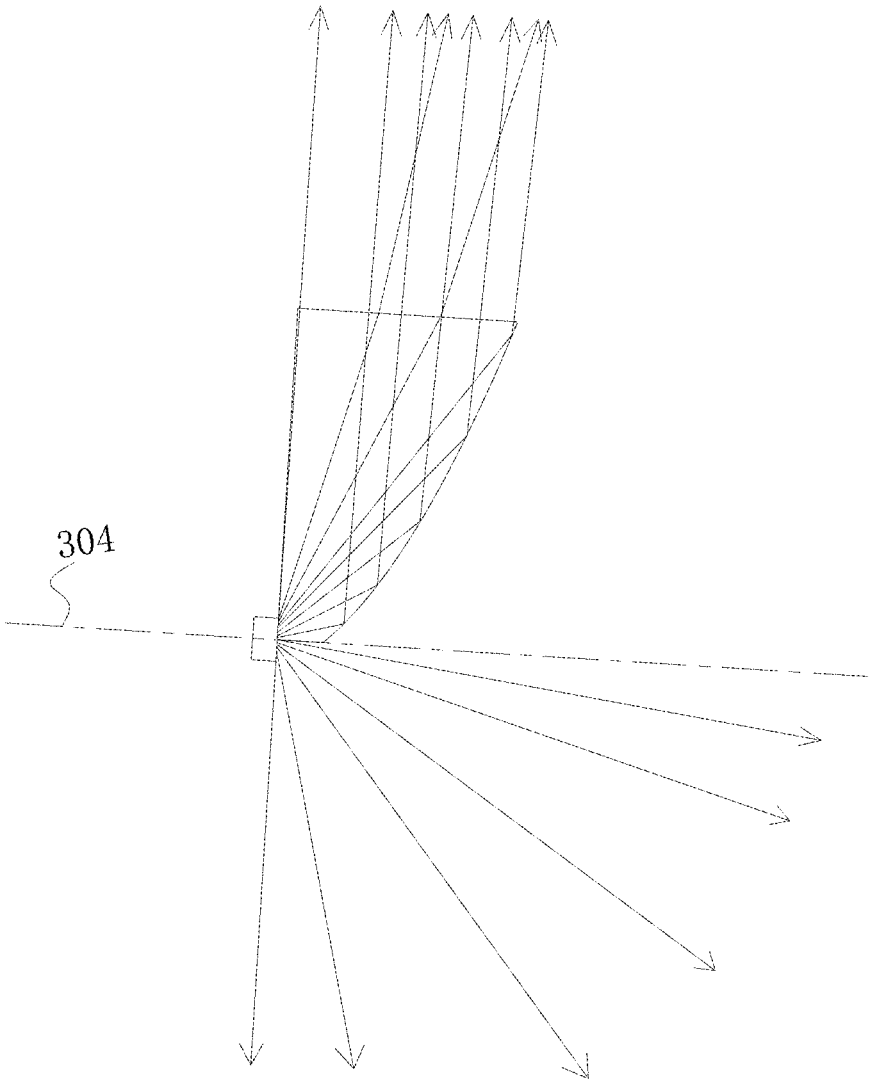
FIG. 14 is an optical path diagram of the first optical element of the shelf lamp of embodiment 4.
Figure 15:
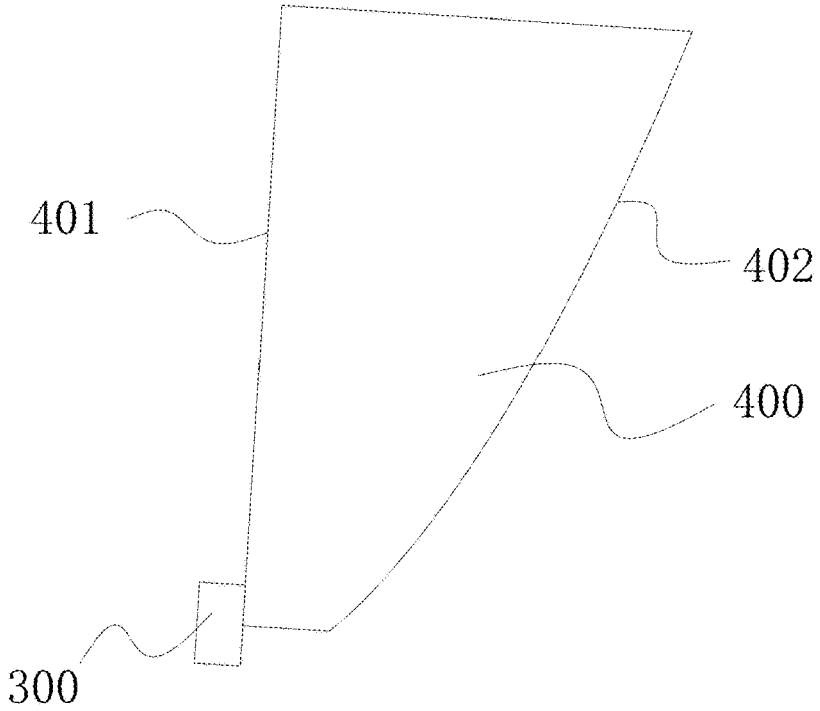
FIG. 15 is a schematic diagram of the structure of the first optical element of the shelf lamp of embodiment 4.

As shown in FIGS. 14 and 15, in this embodiment, except for the first optical element 400, the rest of the structure is the same as that of the embodiment 2.

In this embodiment, the first optical element 400 is not provided with the recess 404 and the auxiliary light-emitting surface 405, and the light splitting is completely realized by the total reflection surface 402. In this case, the size of the first optical element 400 needs to be set to be larger and the appearance structure is simpler.

Embodiment 5

Figure 16:
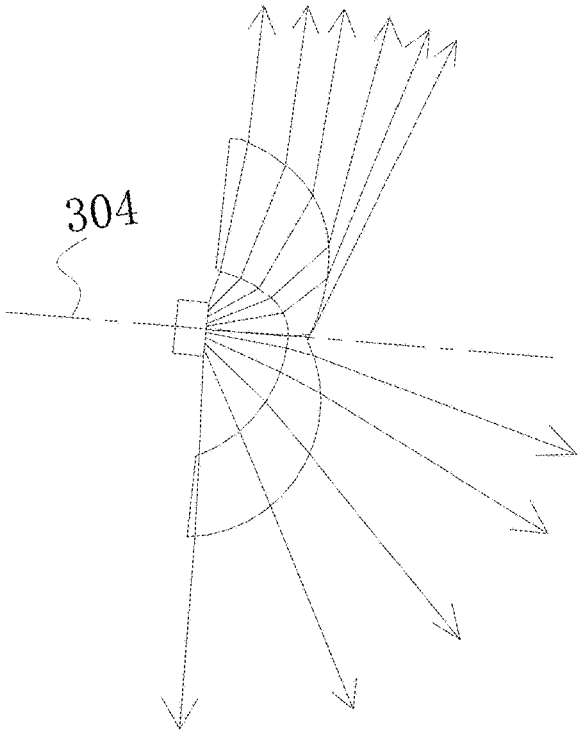
FIG. 16 is an optical path diagram of the optical element of the shelf lamp of embodiment 5.
Figure 17:
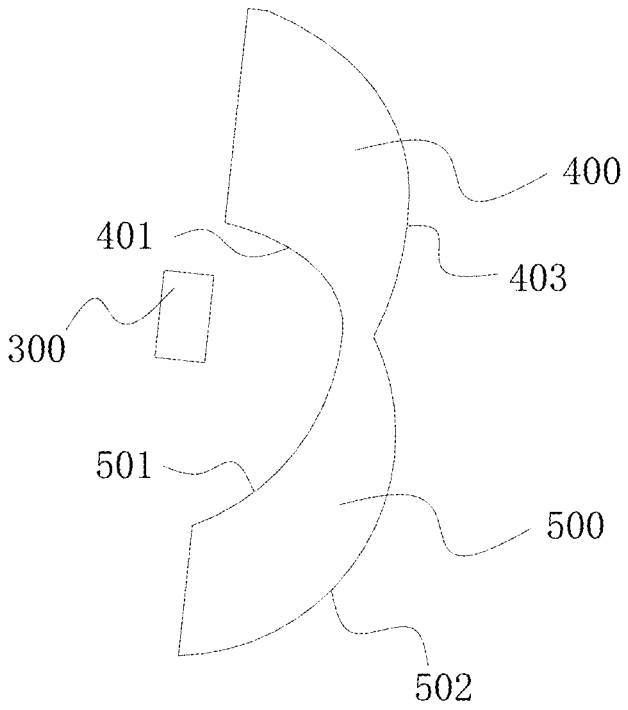
FIG. 17 is a schematic diagram of the structure of the optical element of the shelf lamp of embodiment 5.

As shown in FIGS. 16 and 17, in this embodiment, except for the first optical element 400, the rest of the structure is the same as that of Embodiment 1.

In this embodiment, when the first optical element 400 is a optical lens, the first optical element 400 includes a first light entrance surface 401 and a first light-emitting surface 403. The first light entrance surface 401 deflects at least part of the upper illumination light 302 upward for the first time; the first light exit surface 403 further deflects at least part of the upper illumination light 302 upward and projects it to the upper edge 2002 and its outer area. Specifically, the first light entrance surface 401 and the first light exit surface 403 are both light splitting curved surfaces.

Figure 18:
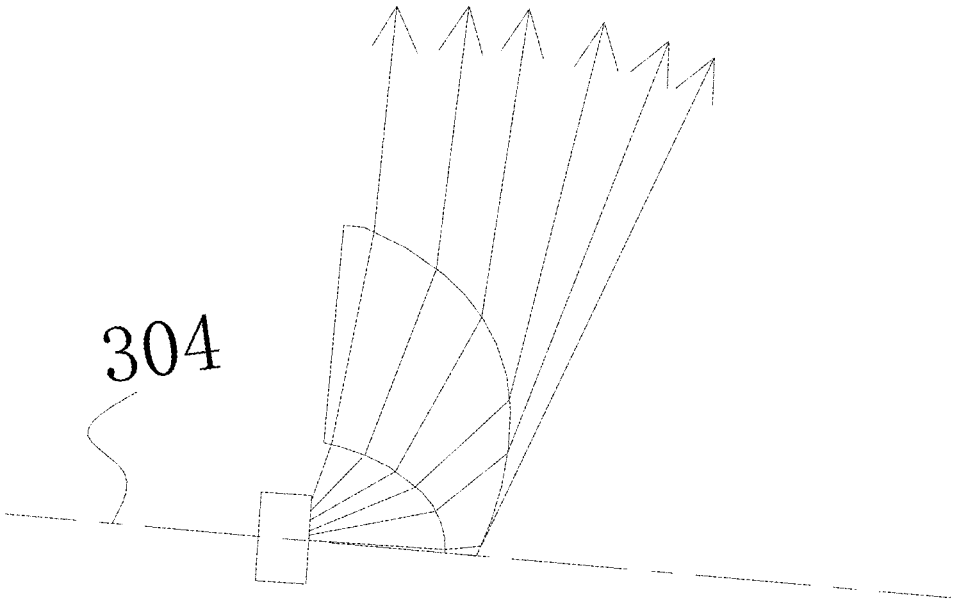
FIG. 18 is an optical path diagram of the shelf lamp of embodiment 5 using only the first optical element.

The second optical element 500 may not be provided in this embodiment, as shown in FIGS. 17 and 18.

Embodiment 6

Figure 19:
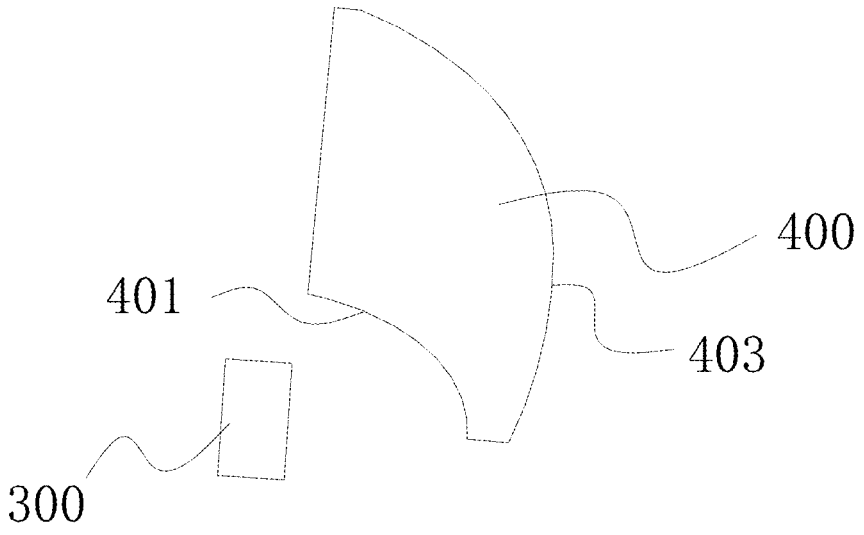
FIG. 19 is a schematic diagram of the structure of the shelf lamp of embodiment 5 using only the first optical element.
Figure 20:
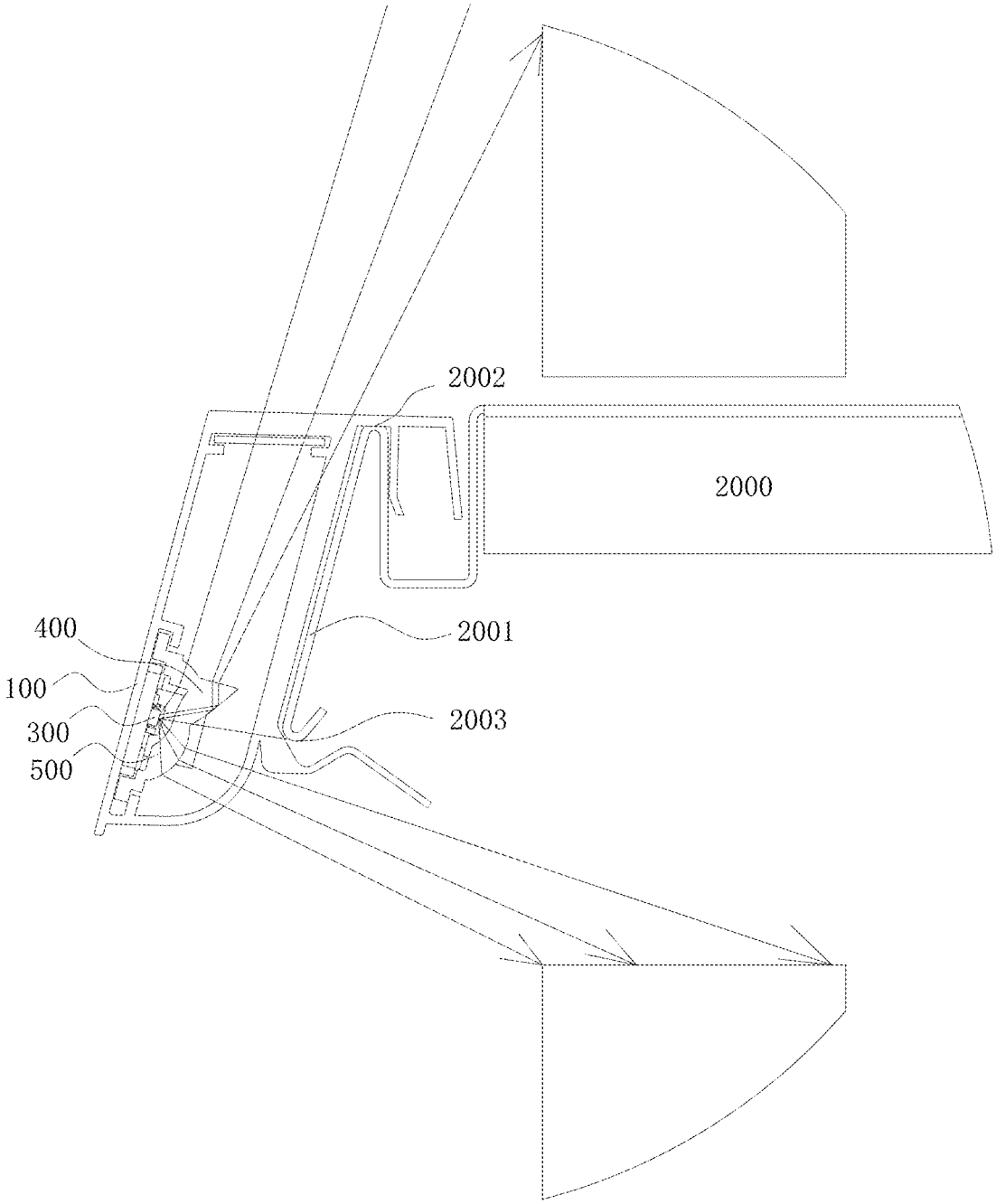
FIG. 20 is a schematic cross-sectional view of the shelf lamp of embodiment 6 on a plane perpendicular to the longitudinal direction of the laminate after being installed on the shelf.

As shown in FIG. 19, in this embodiment, except that the identification plate mounting seat 4000 is not provided, the rest of the structure is the same as that of Embodiment 1.

In this embodiment, in order to facilitate installation, the lamp holder 100 further includes a buckle structure fixedly connected to the laminate 2000.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A shelf lamp (1000), comprising: a lamp holder (100), a circuit board (200), a light source (300) and a first optical element (400);

the lamp holder (100) is provided with a mounting seat (101) opposite to an outer panel (2001) of a laminate (2000);

the circuit board (200) is arranged on one side of the mounting seat (101) facing the outer panel (2001), and is located vertically below a plane where an upper edge (2002) of the outer panel (2001) is located;

the light source (300) is arranged on the circuit board (200) and its light exit direction faces toward a shelf back plate (3000), and a plane formed by the main optical axis (304) of the light source (300) extending along a lengthwise direction of the outer panel (2001) is an interface (301), and at least part of the light from the light source (300) above the interface (301) is projected above the laminate (2000) as an upper illumination light (302) which illuminates the upper side of the laminate, and at least part of the light from the light source (300) located below the interface (301) is projected below the laminate (2000) as a lower illumination light (303) which illuminates the lower side of the laminate;

wherein:

the first optical element (400) is arranged in a light emitting direction of the upper illumination light (302) to deflect upward at least part of the upper illumination light (302), the first optical element (400) is an optical lens, the first optical element (400) includes:

a first light entrance surface (401) arranged in the light exit direction of the upper illumination light (302), a total reflection surface (402) arranged on an outer side of the first light entrance surface (401) along the light exit direction of the upper illumination light (302) and one end away from the interface (301) is inclined toward the outer panel (2001), and is used to totally reflect part of the upper illumination light (302) located at and close to the interface (301);

a first light emitting surface (403) refracting the light from the total reflection surface (402) and projecting the light onto the upper edge (2002) and its outer area; and an auxiliary light-emitting surface (405), one end of which is connected to the first light-emitting surface (403);

one side of the first optical element (400) facing toward the light source (300) has a recess (404) for disposing the light source (300), wherein the first light entrance surface (401) comprises a concave top surface (4011) and a concave side wall (4012), and the concave top surface (4011) is a light-condensing and light-receiving surface on the opposite side of the total reflection surface (402), which is used to condense part of the upper illumination light (302) located at and close to the interface (301) to the total reflection surface (402), and the concave side wall (4012) is a light-condensing and light-receiving surface which projects light through the auxiliary light-emitting surface (405) to the upper edge (2002) and its outer area;

a connection line between the light source (300) and a lower edge (2003) of the outer panel defines a C direction, and an included angle between the C direction and a vertical downward direction is greater than 45°.

2. The shelf lamp as claimed in claim 1, wherein the included angle between the C direction and the vertical downward direction is less than 90° or greater than 70°.

3. The shelf lamp as claimed in claim 1, wherein in a plane perpendicular to the upper edge (2002) of the outer panel (2001), an included angle between the main optical axis (304) of the light source (300) and the C direction is ±10° or less than 90°.

4. The shelf lamp as claimed in claim 1, wherein in a plane perpendicular to the upper edge (2002), a connecting line between the light source (300) and the upper edge (2002) is defined as the A direction, and a B direction is defined by a line passing orthogonally through the center of the light source (300);

after the upper illumination light (302) is dimmed by the first optical element (400), its maximum light intensity emission direction and its ½ light intensity direction close to the outer side of the laminate are both located between the A direction and the B direction.

5. The shelf lamp as claimed in claim 1, wherein the first light entrance surface (401) deflects at least part of the upper illumination light (302) upward for the first time;

the first light-emitting surface (403) further deflects at least part of the upper illumination light (302) upward and projects the upper illumination light (302) onto the upper edge (2002) and its outer area.

6. The shelf lamp as claimed in claim 1, wherein the first optical element (400) is a strip lens or a revolved body.

7. The shelf lamp as claimed in claim 1, further comprising a second optical element (500) arranged in the light emitting direction of the lower illumination light (303), and the second optical element (500) is used to deflect at least part of the lower illumination light (303) downward, in particular wherein the second optical element (500) is an optical lens.

8. The shelf lamp as claimed in claim 1, wherein the lamp holder (100) further comprises a sealed lampshade (102) connected to the mounting seat (101), and the sealed lampshade (102) includes an upper side plate (1021), a lower side plate (1022) and a connecting plate (1023); the upper side plate (1021), the lower side plate (1022) are made in light-transmitting material that can emit separately the upper illumination light (302) and the lower illumination light (303), in particular wherein the mounting seat (101) and the sealed lamp cover (102) are integrally formed and manufactured to form a circumferentially sealed strip-shaped sealed cavity.

9. The shelf lamp as claimed in claim 1, wherein the light source (300) comprises a plurality of point light sources arranged at intervals along the length direction, and an optical film (700) is provided above the first optical element (400) to stretch the point light sources into a line light source along the length direction of the strip lens.

10. The shelf lamp as claimed in claim 1, wherein the lamp holder (100) further comprises a buckle structure fixedly connected to the laminate (2000), or wherein the lamp holder (100) is in a strip shape, and the shelf lamp further includes end cover assemblies (600) arranged at both ends of the lamp holder (100).

11. An identification plate lamp, comprising an identification plate mounting frame (4000) and a shelf lamp (1000) as claimed in claim 1 connected to the identification plate mounting frame (4000).

12. The shelf lamp as claimed in claim 7, wherein when the second optical element (500) is an optical lens, the second optical element (500) includes a second light incoming surface (501) and a second light exiting surface (502), and the second light-incoming surface (501) deflects at least part of the lower illumination light (303) downward for the first time, and then the second light emitting surface (502) further deflects the light passing through the second light entrance surface (501) downward; or wherein the optical lens adopted by the first optical element (400) and the second optical element (500) are integrally formed into a strip lens or a revolved body.

13. The shelf lamp as claimed in claim 12, wherein the optical lens adopted by the first optical element (400) and the second optical element (500) is a strip lens manufactured by integral molding, and the upper and lower sides of the strip lens are respectively provided with an upper fixing edge (406) and a lower fixing edge (503), the mounting seat (101) is provided with two installation grooves (1011) extending along the length direction and oppositely arranged, and the two installation grooves (1011) are respectively inserted and fitted with the upper fixing edge (406) and the lower fixing edge (503), in particular wherein a mounting cavity for accommodating the circuit board (200) is formed between the mounting seat (101) and a bottom surface of the strip lens.

14. The identification plate lamp as claimed in claim 11, wherein the identification plate mounting frame (4000) comprises:

an identification plate splint (4001);

a lamp body installation cavity (4002), arranged on the back of the identification plate splint (4001), and being used for the shelf lamp (1000) passing through;

a fixed connecting piece (4003), used to connect the laminate (2000), in particular wherein the fixed connecting piece (4003) is a structure which snaps into place, and the laminate (2000) is provided with grooves or edges that cooperate with the snapping structure.

* * * * *